US006336849B1

(12) United States Patent
Könnemann

(10) Patent No.: US 6,336,849 B1
(45) Date of Patent: Jan. 8, 2002

(54) GRINDING SPINDLE

(76) Inventor: Ronny Könnemann, Habichtweg 3, D-63814 Mainaschaff (DE)

( * ) Notice: Subject to any disclaimer, the term of this patent is extended or adjusted under 35 U.S.C. 154(b) by 0 days.

(21) Appl. No.: 09/601,580

(22) PCT Filed: Feb. 27, 1998

(86) PCT No.: PCT/DE98/00592

§ 371 Date: Sep. 20, 2000

§ 102(e) Date: Sep. 20, 2000

(87) PCT Pub. No.: WO99/39873

PCT Pub. Date: Aug. 12, 1999

(30) Foreign Application Priority Data

Feb. 4, 1998 (DE) ..... 198 04 236

(51) Int. Cl.[7] ..... B24B 7/00; B24B 9/00

(52) U.S. Cl. ..... 451/259; 451/550

(58) Field of Search ..... 451/41, 42, 43, 451/63, 259, 268, 269, 270, 272, 548, 550

(56) References Cited

U.S. PATENT DOCUMENTS 2,309,016 A * 1/1943 Ryan ..... 451/548
2,629,975 A * 3/1953 Desenberg ..... 451/159

* cited by examiner

*Primary Examiner*—Derris H. Banks
(74) *Attorney, Agent, or Firm*—Edwin D. Schindler

(57) ABSTRACT

The invention concerns a grinding spindle, comprising a spindle housing and two coaxial shafts which are driven by a drive motor. A concentric grinding disk is fixed to each of said shafts. The shafts can be moved in an axial direction in relation to each other with a lifting or lowering movement in order to engage one grinding disk or the other. The inner shaft is connected to the drive motor as a main shaft (1), the outer shaft (8) is coupled to said main shaft (1) by a carrier device (10). In addition, a bush (4) is coaxially semimounted on the spindle housing (3), the outer shaft (8) is pivotably mounted on the bush (4) with a pivot bearing (9), and the bush (4) is provided with an actuator (13) which executes the lifting or lowering movement.

18 Claims, 1 Drawing Sheet

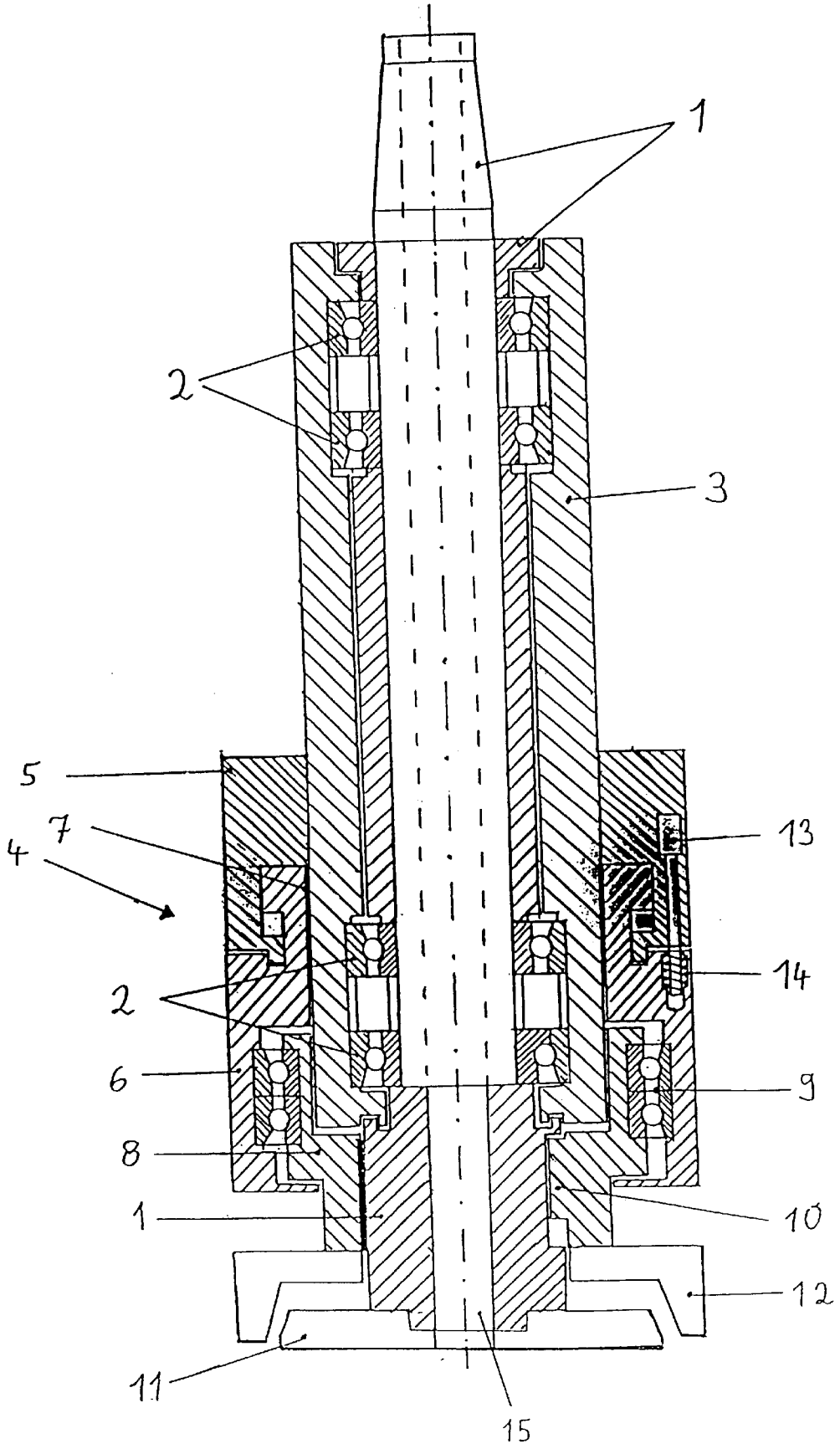
1
2
3
5
7
4
13
14
2
6
9
8
1
10
12
11
15

GRINDING SPINDLE

BACKGROUND OF THE INVENTION

1. Technical Field of the Invention

The invention concerns a grinding spindle, comprising a spindle housing and two coaxial shafts which are driven by a drive motor. A concentric grinding disk is fixed to each of said shafts. The shafts can be moved in an axial direction in relation to each other with a lifting or lowering movement in order to engage one grinding disk or the other.

2. Description of the Prior Art

When the surfaces of flat work pieces are worked, which may, for example, comprise wood, metal, stone, ceramic or also semiconductor material, and for which high requirements must be fulfilled in respect of the surface quality, grinding technology, especially surface grinders, can be used advantageously. To that end, a rotating, multicut cutting tool is used, for example, a grinding disk mounted on a rotating grinding spindle, which is fitted with an abrasive layer comprising bonded grains, for example, a cup grinding wheel with ring-shaped contact surface. An axial feed movement of the rotating grinding tool, generally of the total grinding spindle, brings the grains of the abrasive layer to bear on the surface of the work piece, which results in a removal of material. The use of a fully sintered grinding wheel is also possible. An additional linear or circular feed of the work piece ensures the even working of the total surface of the work piece.

To attain a high work piece surface quality, generally a multi-step, frequently two-step, machining process is applied, where first a coarse-grained grinding disk with a high cutting performance (coarse or rough grinding disk) removes the bulk of the material. The still relatively coarse surface obtained is postprocessed in a subsequent, further work step using a fine-grained grinding disk (fine or finishing grinding disk), which although it only removes a small amount of material achieves a good surface. If both work steps are carried out using the same grinding spindle, it is appropriate to use a grinding spindle which is provided with two grinding disks, each with a different grain size, which can engage selectively with the surface of the work piece. This allows the disadvantages to be avoided which otherwise prevail when grinding tools are changed, such as the time required to reset and the necessary new profiling of the grinding disk owing to the non excludable imprecise fitting, which requires time and leads to a high consumption of abrasive materials. From the state-of-the-art, a grinding spindle of the generic concept is known, for example, (DE-PS 846 663), which has two concentric cup grinding disks carried on two shafts disposed coaxially in a single spindle. The outer shaft is rotated by a motor, while the inner shaft is also moved by means of a carrier device. Thereby, the inner cup grinding disk is disposed in the grinding spindle so as to be moveable axially. Thus selectively the inner or the outer cup grinding disk can be brought to engage, without needing additional resetting or profiling time. A further grinding spindle of the class mentioned at the beginning (DE-PS 42 08 615) uses two cup grinding disks whose abrasive layers comprise uninterrupted ring segments with the same diameter, which engage with one another so that they essentially form one ring and can selectively engage the work piece surface. With this arrangement, both grinding disks function on an identical working radius, which is especially advantageous for the rotary grinding technique, where the feed function of the work piece comprises rotation about an axis extending essentially parallel to the grinding spindle and through the grinding disk abrasive layer. Therefore, different working radiuses of the two grinding disks mean disadvantageously that for the coarse and fine working of identical parts of the work pieces surface a repositioning of the work piece between the two work steps is necessary.

With precision work, for example, the grinding and polishing of silicon wafers, whose breaking strength is determined by their surface quality, sufficient rigidity of the used spindle in the radial direction is of decisive importance, because with a lack of rigidity axial loads upon the spindle can trigger radial oscillations, which can impair the resulting surface quality of the wafer and possibly form grooves, which may provide a predetermined breaking point for the single crystal. To increase the radial rigidity, in the state-of-the-art, the diameter of the spindle is increased, which, however, is only possible in a limited scope. Especially in the case of spindles with an integrated electric motor, where the stator is mounted in the spindle housing and the moved rotor is attached with the outer side to the outer shaft, the diameter of the inner and outer shaft is limited by the space available inside the electric motor. Especially in the case of small grinding spindles, therefore, the necessary radial rigidity cannot be achieved needed for precision work.

SUMMARY OF THE INVENTION

Against this background, it is the object of this invention to create a grinding spindle which can engage two different grinding disks selectively with the work piece and which even when compact in design provides sufficient radial rigidity to fulfil all existing requirements during precision working, such as, for instance, those required when grinding silicon wafers.

In accordance with the invention this task is solved therein that the inner shaft is connected to the drive motor as the main shaft, while the outer shaft is coupled to the main shaft by a carrier device. In addition, a bush is coaxially semimounted on the spindle housing, the outer shaft is pivotably mounted on the bush with a pivot bearing and the bush is provided with an actuator which executes the lifting or lowering movement.

The underlying idea of the present invention is to connect the inner shaft to the drive motor as the main shaft, and to fix the outer shaft which is coupled to the main shaft by means of a suitable carrier device, for example, a carrier pin, so that it rotates together with the main shaft, to the outer side of the spindle housing. To that end, a bush is coaxially semimounted on the spindle housing, the outer shaft is pivotably mounted on the bush with a pivot bearing. For the selective engagement of the grinding disks mounted on the inner and the outer shaft with the work piece, the bush is provided with an actuator which executes the necessary axial lifting or lowering movement Thereby, the grinding disk of the outer shaft can be moved, by means of a lowering movement, below the level of the grinding disk of the inner positioned main shaft and can thus engage with the work piece surface. The lifting movement in the opposite direction of the outer shaft allows the grinding disk of the main shaft to again appear below its counterpart so that it can engage the work piece surface. The advantage of this design of a grinding spindle lies especially in the significant increase in the diameter of the outer shaft and the resulting substantially higher radial rigidity.

Simultaneously, space is acquired inside the grinding spindle for an increase in the diameter of the inside shaft, which also acquires further radial rigidity. Overall, therefore, a grinding spindle is obtained, which enables the successive working of the work piece surface with two different grinding disks, for example, a coarse and fine grinding disk and which at the same time, even when of compact design, owing to the large diameter of the shafts carrying the grinding disks, is stable against radial oscillations and so advantageously can be used especially for precision work.

The drive of the inventive grinding spindle can be realized, for example, by means of a belt pulley fixed coaxially to the main shaft, which drives the drive motor via a suitable belt.

In a preferred inventive embodiment, to drive the grinding spindle, however, an electric motor is used which is integrated in the spindle housing and which penetrates the main shaft. Thereby, for example, the rotating rotor of the electric motor can be attached by the outer side to the inner shaft and the fixed stator can be integrated in the spindle housing. In this way, one obtains a very compact grinding spindle, which does not require exterior drive parts for its rotary actuation. Motors driven hydraulically or by compressed air can also be considered for the drive of the grinding spindle.

As an actuator for the axial lifting and lowering movement of the outer shaft, preferably a pneumatically driven cylinder is used in conjunction with a return spring. However, hydrostatic, electromagnetic, electromotive or mechanical actuators are for example also conceivable.

To machine a work piece, the grinding spindle must be lowered, or the work piece lifted, until the grinding disk engages the work piece surface. Thereby the problem arises that the distance between the grinding disk and the work piece surface is not known in many cases with sufficient exactness. Therefore, in an inventive development, the grinding disk is equipped with a sensor, which registers the contact of grinding disk and work piece, for example, via the vibrations generated or displacements of the shaft, and emits a signal which stops the movement of the grinding spindle and starts the predefined grinding cycle.

If especially high requirements exist in respect of the surface quality of the work piece, as, for example, may be the case for silicon wafers for use in chip cards, a two-hour working of the surface with a coarser and a finer grinding disk is frequently insufficient so that at least a further working step with an extra fine grinding disk or a polishing cloth is necessary. To also operate in such a case with a single grinding spindle without a time-consuming and costly change of tool, in a further development of the invention, it is proposed to provide the grinding spindle with a further inner shaft disposed coaxially within the main shaft, which can be equipped with a further grinding disk or a polishing cloth as a tool and which can also engage the work piece surface. This inner shaft, owing to its comparatively low diameter, has a low radial rigidity and thus is especially suitable for the polishing process for which high rigidity is not needed. This special embodiment of the inventive grinding spindle can therefore be advantageously used to first pre-grind a work piece surface, then to finish the grinding and finally to polish the work piece in a single machine.

When needed, the inventive grinding spindle can of course have more than one bush coaxially semimounted on the spindle housing to which respectively one shaft provided with a grinding disk is coaxially pivotably mounted in relation to the main shaft and is connected rotationally rigidly to the main shaft via a carrier device. Here, too, the additional grinding disks can also selectively individually engage the work piece surface by means of actuators disposed on the bushes for lifting and lowering movements. In this way, the number of machining and removing processes executable using the inventive grinding spindle can be increased and varied virtually infinitely.

In an especially simple embodiment of the invention, the two or also more grinding disks used comprise concentrically disposed cup grinding disks so that the abrasive layers used form concentric rings. Here, the abrasive layer of the inner grinding disk can also be embodied in the form of a circular disk, which, depending on the embodiment of the grinding spindle, is surrounded by the other abrasive layer as a concentric circular ring or by the other abrasive layers as concentric circular rings with possibly different working radiuses. With different working radiuses, different groove ring diameters and groove depths can also be cut.

When the inventive grinding spindle is to be used for the technique of rotary grinding, identical working radiuses of the used grinding disks are highly advantageous. For that purpose, the inventor recommends configuring the grinding disks used as cup grinding disks with an identical working radius whose abrasive layers have the form of uninterrupted circular rings whose segments engage one another and complement one another to form one circular ring. With this special embodiment of the grinding disks, the inventive grinding spindle can also be advantageously used for rotary grinding. Of course, any combination of grinding disks with the same and different working radiuses is conceivable.

During the grinding process, the work piece is ordinarily cooled. For that purpose, the inventor recommends providing the outer shaft or the additional inner shaft of the grinding spindle with a continuous axial bore by means of which a suitable coolant can be supplied to the machining process.

When it is necessary, to achieve the required quality of a work piece surface, to use more grinding disks than can be suitably disposed on a single grinding disk, the inventor recommends providing a grinding system with at least two inventive grinding spindles. Thus even multi-step machining processes can be carried out advantageously without the disadvantages associated with tool changes such as long setting-up times and the necessity of re-profiling the grinding disk, whereby the high radial rigidity of the grinding spindles used allows high precision work piece surfaces to be achieved.

BRIEF DESCRIPTION OF THE DRAWING FIGURES

Further details, features and advantages of the invention can be taken from the following description part in which with the aid of a drawing a typical embodiment of the invention is explained in greater detail.

It shows a vertical section through an inventive grinding spindle in a diagrammatic representation.

DETAILED DESCRIPTION OF THE DRAWING AND PREFERRED EMBODIMENTS

The main shaft (1) of the inventive grinding spindle in this example is pivotably mounted by means of two pairs of deep-groove ball bearings (2) in the spindle housing (3). Here other types of rolling bearings can be used, or also hydrodynamic and hydrostatic bearings, air-cushion bearings or magnet bearings. The rotary drive of the inventive grinding spindle is realised via a belt pulley not shown here, which is fixed coaxially to the main shaft and which is driven via a corresponding belt driven by the drive motor. A bush (4) is coaxially semimounted on the spindle housing (3), whose upper part (5) is fastened rigidly to the spindle housing, while the associated bottom part (6) can be moved axially in a limited scope. In the example, the relative movement of the bottom part (6) and the spindle housing (3) is guided via the sliding bearing bush (7), whereby this guidance of course can also be realised in a different way, for instance, by means of a ball box. The outer shaft (8) of the inventive grinding spindle is pivotably mounted in a pivot bearing (9), comprising two ball bearings, in the bottom part (6) of the bush (4) and is connected to the main shaft (1) via a carrier device (10). On the bottom side of the main shaft (1) and the outer shaft (8) there is flange-mounted respectively a grinding disk (11, 12) with several screws. The abrasive layer of the inner grinding disk (11) has the form of a circular area which surrounds the abrasive layers of the outer grinding disk (12) as a concentric circular ring. In the figure, the outer shaft (8), together with its grinding disk (12), is located in an axially withdrawn position so that the inner grinding disk (11) cam engage the work piece surface and can machine the same. To bring the outer grinding disk (12) to engage, the pneumatic cylinder (13) is impinged which moves the bottom part of bush (8), together with the outer shaft and the grinding disk, axially downwards in a lowering movement until the abrasive layer of the grinding disk (12) projects beyond the grinding disk (11). If the force effect of the pneumatic cylinder (13) is deactivated, the return spring (14) returns the bottom part of the bush (6), the outer shaft (10) and the grinding disk (12) to their starting position. The definitive axial grinding position, however, is determined by the axial position of the total grinding spindle. For this purpose, the spindle housing (3) is connected to a saddle construction, not shown here, which allows the entire structure shown in the figure to move axially in wide limits. This movement is also exploited for the actual feed function of the grinding process. An axial, continuous bore (15) extending through the main, shaft (1) allows a suitable liquid coolant to be supplied to the work piece surface and the grinding disk (11, 12) during the grinding process.

As a result one obtains a grinding spindle with two grinding disks, which can engage selectively. The grinding spindle has a high radial rigidity and is therefore also very suitable for precision work.

I claim:

1. A grinding spindle, comprising:

a spindle housing;

an actuator for effecting a lifting or towering movement;

a bush is coaxially mounted on said spindle housing, said bush being provided with said actuator;

a drive motor;

a carrier device;

two coaxial shafts drivable by said drive motor, a first of said coaxial shafts being an inner shaft, or a main shaft, and a second of said coaxial shafts being an outer shaft, said main shaft being connected to said drive motor and said outer shaft being coupled to said main shaft by said carrier device, with said outer shaft being pivotably mounted on said bush with a pivot bearing; and, a concentric grinding disk fixed to each of said coaxial shafts, said two coaxial shafts being movable in an axial direction relative to one another in a lifting movement or a lowering movement via said actuator for engaging at least one of said concentric grinding disks.

2. The grinding spindle according to claim 1, further comprising a belt pulley fixed coaxially to said main shaft for allowing said drive motor to drive said main shaft.

3. The grinding spindle according to claim 1, wherein said drive motor is an electric motor which reaches through said main shaft.

4. The grinding spindle according to claim 1, wherein said drive motor is a hydraulic motor which reaches through said main shaft.

5. The grinding spindle according to claim 1, wherein said drive motor is a compressed-air motor which reaches through said main shaft.

6. The grinding spindle according to claim 1, wherein said carrier device is a carrier pin connecting said main shaft to said outer shaft in a rotationally rigid manner.

7. The grinding spindle according to claim 1, wherein said actuator is a pneumatic actuator.

8. The grinding spindle according to claim 1, further comprising a sensor for recording contact between at least one of said concentric grinding disks and a workpiece.

9. The grinding spindle according to claim 8, wherein said sensor records vibrations between at least one of said concentric grinding disks and the workpiece.

10. The grinding spindle according to claim 8, wherein said sensor records linear deformations between at least one of said concentric grinding disks and the workpiece.

11. The grinding spindle according to claim 8, wherein said sensor records movement between at least one of said concentric grinding disks and the workpiece.

12. The grinding spindle according to claim 1, further comprising an additional inner shaft disposed coaxially within said main shaft.

13. The grinding spindle according to claim 12, further comprising a polishing disk engageable with said additional inner shaft.

14. The grinding spindle according to claim 1, further comprising an additional bush coaxially semi-mounted on said spindle housing.

15. The grinding spindle according to claim 1, wherein said concentric grinding disk of said main shaft has abrasive layers forming concentric rings.

16. The grinding spindle according to claim 1, wherein said concentric grinding disk of said main shaft and said concentric disk of said outer shaft have uninterrupted circular rings with segments thereof which engage with one another and complement one another to form one circular ring.

17. The grinding spindle according to claim 1, wherein said concentric grinding disk of said main shaft and said concentric disk of said outer shaft each have abrasive layers having the form of uninterrupted circular rings with segments thereof engaging one another and complementing one another to form a circular ring.

18. The grinding spindle according to claim 1, wherein said main shaft has a continuous axial bore.

* * * * *